US005746219A

United States Patent [19]

McConnell

[11] Patent Number: 5,746,219

[45] Date of Patent: May 5, 1998

[54] INFANT SLEEP POSITIONING DEVICE

[76] Inventor: Thomas E. McConnell, 1568 Calzada Ave., Santa Ynez, Calif. 93460

[21] Appl. No.: 732,134

[22] Filed: Oct. 18, 1996

[51] Int. Cl.[6] ..... A61G 15/00

[52] U.S. Cl. ..... 128/845; 128/873; 128/876

[58] Field of Search ..... 128/845, 846, 128/869, 873, 874, 875, 876; 602/19; 269/484, 485, DIG. 6

[56] References Cited

U.S. PATENT DOCUMENTS

| | | | |
|---|---|---|---|
| 3,536,067 | 10/1970 | Sternagel | 128/873 |
| 4,672,958 | 6/1987 | Garman | 128/873 |
| 5,309,926 | 5/1994 | Mayton | 128/869 |
| 5,439,008 | 8/1995 | Bowman | 128/875 |
| 5,494,052 | 2/1996 | Grohman | 128/873 |

*Primary Examiner*—Michael A. Brown

*Attorney, Agent, or Firm*—Stetina Brunda Garred & Brucker

[57] ABSTRACT

An infant sleep positioning device for maintaining an infant in a back sleeping position upon an underlying support surface. The positioning device comprises an elongate belt member which is extensible along the support surface and defines opposed ends. Attached to the belt member adjacent respective ones of the opposed ends thereof is a pair of fastener straps. Additionally, disposed upon the belt member substantially intermediate the opposed ends thereof is a first attachment member. The positioning device further comprises a diaper member sized and configured to be wrapped about the pelvic region of the infant. The diaper member includes a second attachment member disposed thereon which is positioned over the buttocks of the infant when the diaper member is wrapped about the pelvic region. The second attachment member is releasably engagable to the first attachment member for purposes of maintaining the back of the infant upon the support surface.

6 Claims, 2 Drawing Sheets

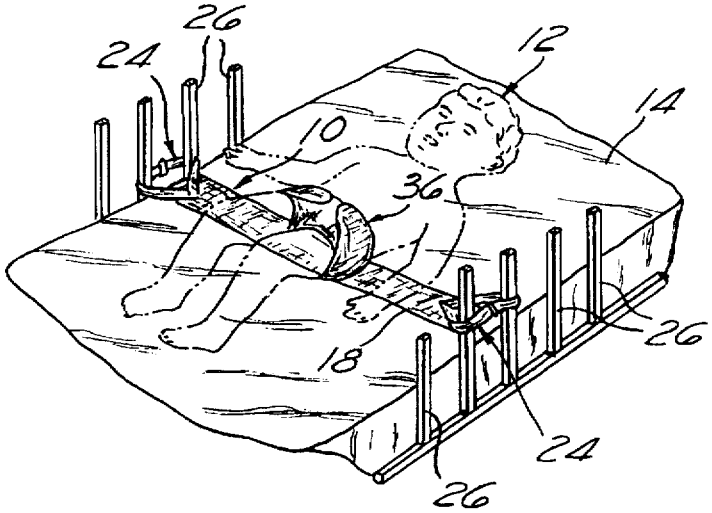
Fig. 1
Fig. 2
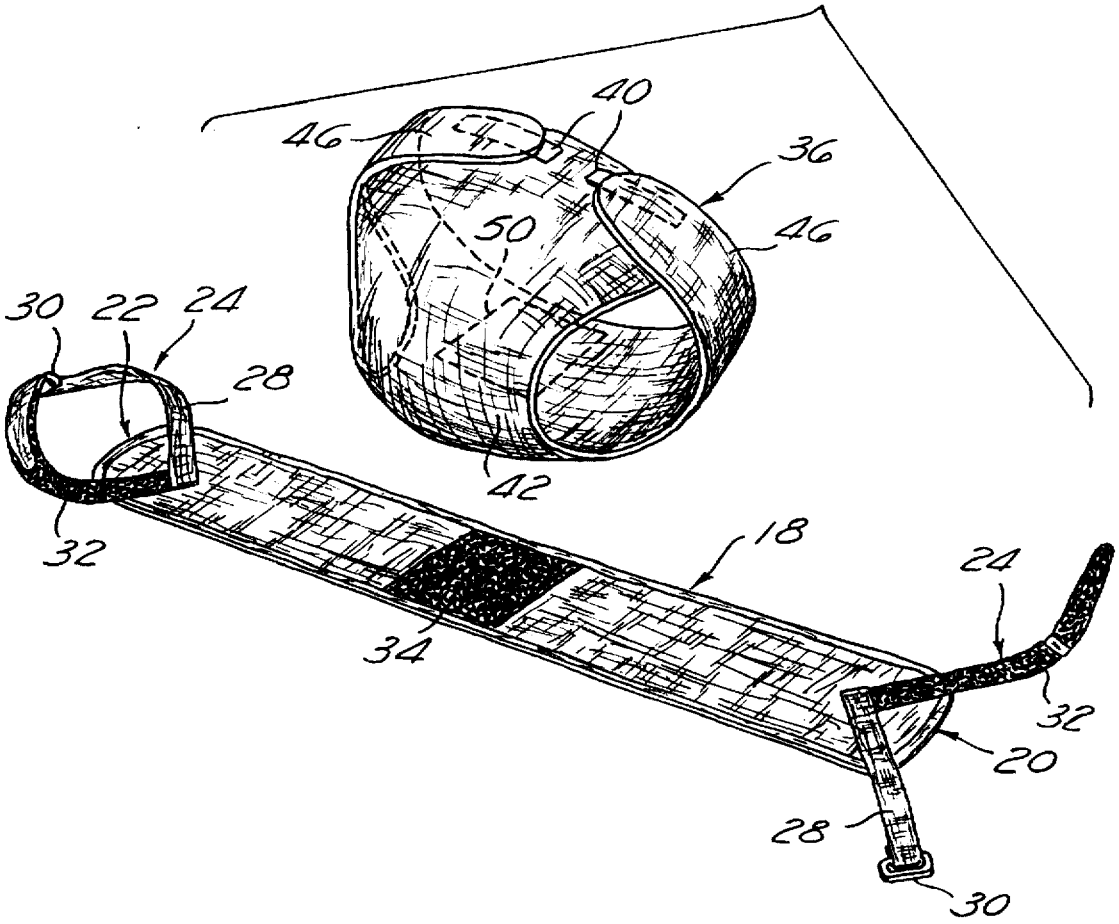

INFANT SLEEP POSITIONING DEVICE

FIELD OF THE INVENTION

The present invention relates generally to infant accessories, and more particularly to a positioning device for maintaining an infant upon its back when sleeping in a crib or cradle.

BACKGROUND OF THE INVENTION

In recent years, it has been well documented in the medical community that occurrences of Sudden Infant Death Syndrome ("SIDS") are substantially reduced when infants are maintained upon their backs or sides when sleeping in a crib or cradle. In recognition of these medical research findings, there has been developed in the prior art various devices for maintaining a baby in a back or side sleeping position.

One such device comprises a pair of wedge-shaped members of differing lengths which are maintained in spaced relation to each other by a piece of cloth extending therebetween. This particular device is adapted to maintain an infant in a side sleeping position by placing the infant between the wedge-shaped members such that the shorter member rests against the infant's stomach and the longer member extends along the infant's back. In this respect, the wedge-shaped members prevent the infant from either rolling on its stomach or on its back. However, a deficiency associated with this particular prior art device, as well as those adapted to maintain an infant in a back sleeping position, is that such devices, though preventing the infant from rolling over onto its side (i.e., back sleeping position devices) or stomach (i.e., back and side sleeping position devices), afford the infant very little freedom of movement. Additionally, certain prior art sleep positioning devices are somewhat cumbersome, and difficult to interface to existing cribs or cradles.

The present invention addresses the shortcomings in the prior art by providing an infant sleep positioning device which is adapted to comfortably position a baby in the back sleeping position which is currently recommended by most SIDS researchers. Though maintaining the baby in the back sleeping position, the device constructed in accordance with the present invention still affords the baby substantial freedom of movement, save the ability to roll over onto its side or stomach. Additionally, the device constructed in accordance with the present invention is adapted to be quickly and easily interfaced to a crib or cradle.

SUMMARY OF THE INVENTION

In accordance with the present invention, there is provided an infant sleep positioning device for maintaining an infant in a back sleeping position upon an underlying support surface within a support structure such as a crib or cradle. The positioning device comprises an elongate belt member which is extensible along the support surface and defines opposed ends. Attached to respective ones of the opposed ends of the belt member is a pair of fastener straps which are releasably attachable to the support structure for purposes of maintaining the belt member in a taut or tightly drawn configuration across the support surface. Disposed on the belt member substantially intermediate the opposed ends thereof is a first attachment member.

In the preferred embodiment, each of the fastener straps of the belt member comprises a first strap segment having a proximal end which is attached to the belt member and a distal end having a loop member attached thereto. In addition to the first strap segment, each fastener strap includes a second strap segment having a proximal end attached to the belt member and a distal end which is extensible through the loop member. The first and second strap segments are fabricated from hook and loop fastener material, and are releasably engagable to each other subsequent to the extension of the distal end of the second strap segment through the loop member.

In addition to the belt member, the positioning device of the present invention comprises a diaper member which is sized and configured to be wrapped about the pelvic region of the infant. The diaper member includes a second attachment member disposed thereon which is positioned over the buttocks of the infant when the diaper member is wrapped about the pelvic region. The diaper member itself preferably comprises a front region which is positionable over the stomach of the infant and a middle region which is positionable over the crotch of the infant. In addition to the front and middle regions, the diaper member includes a back region which is positionable over the buttocks of the infant, with the second attachment member being disposed upon the back region. The front and back regions each include securing members disposed thereon which are releasably engagable to each other for maintaining the diaper member upon the pelvic region of the infant. The securing members each preferably comprise a strip of hook and loop fastener material.

In the positioning device of the present invention, the second attachment member of the diaper member is releasably engagable to the first attachment member of the belt member. The engagement of the first and second attachment members to each other maintains the back of the infant upon the support surface within the support structure.

In accordance with an alternative embodiment of the present invention, the belt member may be used in conjunction with an infant bodysuit including the second attachment member disposed thereon which is positioned over the buttocks of the infant when the infant is dressed in the bodysuit.

BRIEF DESCRIPTION OF THE DRAWINGS

These, as well as other features of the present invention, will become more apparent upon reference to the drawings wherein:

FIG. 1 is a perspective view of the infant sleep positioning device of the present invention as used to maintain the back of an infant upon an underlying support surface within a support structure;

FIG. 2 is an exploded view of the infant sleep positioning device of the present invention;

DETAILED DESCRIPTION OF THE PREFERRED EMBODIMENTS

Figure 3:
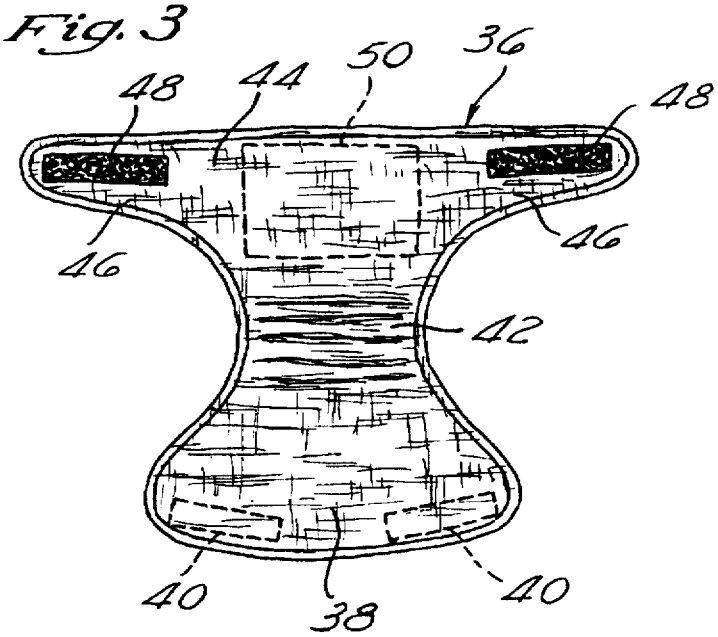
FIG. 3 is a front plan view of the diaper member of the infant sleep positioning device shown in FIGS. 1 and 2.

Referring now to the drawings wherein the showings are for purposes of illustrating preferred embodiments of the present invention only, and not for purposes of limiting the same, FIG. 1 perspectively illustrates the infant sleep positioning device 10 constructed in accordance with the present invention. As seen in FIG. 1, the positioning device 10 is adapted to maintain the back of an infant 12 upon the underlying support surface 14 of a crib 16 or other support structure such as a cradle. As previously indicated, medical studies have concluded that maintaining the infant 12 in the back-sleeping position substantially reduces occurrences of SIDS.

Referring now to FIGS. 1 and 2, the positioning device 10 constructed in accordance with the preferred embodiment of the present invention comprises an elongate belt member 18 which is preferably fabricated from a fabric material and defines opposed first and second ends 20, 22. Attached to the belt member 18 adjacent respective ones of the first and second ends 20, 22 thereof is a pair of fastener straps 24. As best seen in FIG. 1, the belt member 18 is extensible along the support surface 14, with the fastener straps 24 being releasably attachable to respective ones of the vertically extending side rails 26 of the crib 16 for purposes of maintaining the belt member 18 in a taut or tightly drawn configuration across the support surface 14.

In the positioning device 10, each of the fastener straps 24 comprises a first strap segment 28 having a proximal end attached to the top surface of the belt member 18 and a distal end having a loop member attached thereto. In addition to the first strap segment 28, each fastener straps 24 comprises a second strap segment 32 having a proximal end attached to the top surface of the belt member 18 and a distal end which is extensible through the loop member 30 of the first strap segment 28. When attached to the belt member 18, the proximal ends of the first and second strap segments 28, 32 of each fastener strap 24 preferably overlap each other, with the remainders of the first and second strap segments 28, 32 extending at right angles relative to each other (i.e., being separated by approximately 90°).

The first and second strap segments 28, 32 of each fastener strap 24 are preferably fabricated from hook and loop fastener material, and are releasably engageable to each other subsequent to the extension of the distal end of the second strap segment 32 through the loop member 30 of the corresponding first strap segment 28.

In the positioning device 10, the first strap segment 28 need not be fabricated from hook and loop fastener material. In this respect, the second strap segment 32 may include separate sections of hook and loop fastener material which are attached to each other subsequent to the extension of the distal end of the second strap segment 32 through the loop member 30, thereby securing the first and second strap segments 28, 32 to each other. If not fabricated from hook and loop fastener material, the first strap segment 28 is preferably fabricated from a fabric material. As best seen in FIG. 2, the proximal ends of the first and second strap segments 28, 32 of each fastener strap 24 are not secured directly to respective ones of the first and second ends 20, 22 of the belt member 18, but rather are attached to the top surface of the belt member 18 at locations disposed inwardly relative to the first and second ends 20, 22.

Though not shown, those of ordinary of skill in the art will recognize that the belt member 18 of the positioning device 10 may be provided with alternative fastening members for facilitating the releasable attachment thereof to the crib 16 or other support structure. In this respect, though not shown, the belt member 18 may be provided with pairs of fastener straps which are secured directly to respective ones of the first and second ends 20, 22 thereof. In this arrangement, the proximal ends of the fastener straps of each pair may be secured directly to a respective one of the first and second ends 20, 22 in spaced relation to each other or, alternatively, at a common location thereon.

In addition to the fastener straps 24, disposed of the top surface of the belt member 18 substantially intermediate the first and second ends 20, 22 thereof is a first attachment member 34. In the preferred embodiment, the first attachment member 34 has a generally rectangular configuration, and is fabricated from a patch of hook and loop fastener material. The preferred width of the first attachment member 34 is such that the same extends substantially between the opposed longitudinal sides of the belt member 18 when disposed thereon.

Referring now to FIGS. 1–4, the positioning device 10 constructed in accordance with the present invention further comprises a diaper member 36 which is sized and configured to be wrapped about the pelvic region of the infant 12 in the manner shown in FIG. 1. Like the belt member 18, the diaper member 36 is preferably fabricated from a fabric material.

Figure 4:
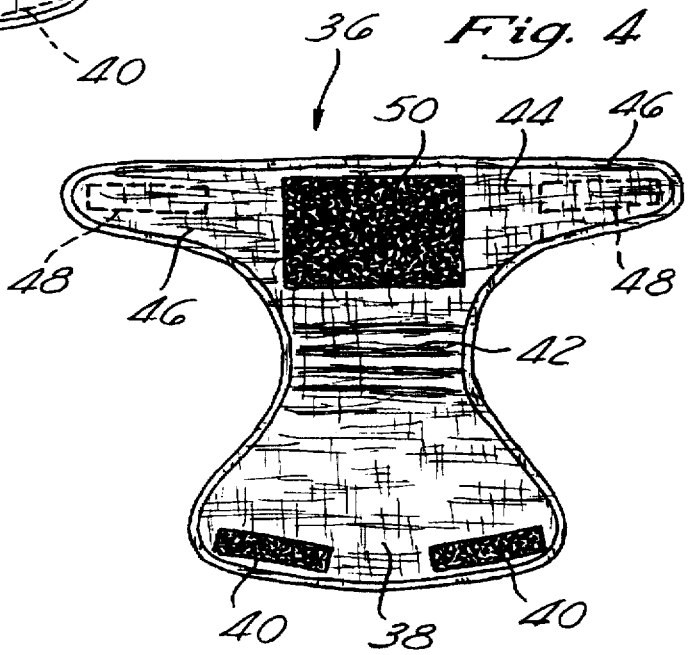
FIG. 4 is a rear plan view of the diaper member of the infant sleep positioning device shown in FIGS. 1 and 2.

As best seen FIGS. 3 and 4, the diaper member 36 has a generally hourglass-shaped configuration, and includes a front region 38 which is positionable over the stomach of the infant 12. Disposed on the outer surface of the front region 38 is a spaced pair of securing members 40. In the preferred embodiment, the securing members 40 each comprise an elongate strip of hook and loop fastener material. In addition to the front region 38, the diaper member 36 includes a reduced width, narrow middle region 42 which is positionable over the crotch of the infant 12. The diaper member 36 further comprises a back region 44 which is positionable over the buttocks of the infant 12 and includes an opposed pair of outwardly extending ear portions 46. Disposed on and extending along the inner surfaces of respective ones of the ear portions 46 is a pair of securing members 48. Like the securing members 40, the securing members 48 are each preferably fabricated from an elongate strip of hook and loop fastener material.

Disposed on the outer surface of the back region 44 of the diaper member 36 substantially intermediate the ear portions 46 is a second attachment member 50. Like the first attachment member 34 of the belt member 18, the second attachment member 50 is preferably fabricated from a patch of hook and loop fastener material which has a generally rectangular configuration. As best seen in FIG. 4, the second attachment member 50 extends from approximately the top edge of the back region 44 to the middle region 42.

The diaper member 36 is typically wrapped about the pelvic region of the infant 12 by initially positioning the buttocks of the infant 12 upon the inner surface of the back region 44. Thereafter, the front region 38 is grasped and pulled upwardly between the infant's legs, with the inner surface thereof being placed upon the infant's stomach. When the inner surface of the front region 38 is positioned upon the infant's stomach, the middle region 42 of the diaper member 36 is extended about and covers the infant's crotch. The ear portions 46 of the back region 44 are then drawn upwardly along the infant's sides, with the securing members 48 disposed on the inner surfaces thereof being releasably engaged to respective ones of the securing members 40 disposed on the outer surface of the front region 38. As will be recognized, the engagement of the securing members 40, 48 to each other maintains the diaper member 36 upon the pelvic region of the infant 12. When the diaper member 36 is applied to the pelvic region of the infant 12 in the aforementioned manner, the second attachment member 50 disposed on the outer surface of the back region 44 is positioned over the buttocks of the infant 12. Typically, the diaper member 36 will be applied to the infant 12 over a cloth diaper or disposable diaper pre-positioned upon The positioning region.

The positioning device 10 of the present invention is utilized by initially extending the belt member 18 across the support surface 14 and attaching the fastener straps 24 to respective ones of the side rails 26 so as to maintain the belt member 18 in a taut configuration over the support surface 14. Subsequent to the positioning of the diaper member 36 upon the pelvic region of the infant 12 in the aforementioned manner, the second attachment member 50 thereof is releasably engaged to the first attachment member 34 of the belt member 18. As will be recognized, the engagement of the first and second attachment members 34, 50 to each other effectively maintains the back of the infant 12 upon the support surface 14, i.e., maintains the infant 12 in a back-sleeping position. Although the infant 12 is prevented from rolling over onto its side or stomach, the infant 12 is still afforded substantial freedom of movement upon the support surface 14. The infant's lack of lower body strength prevents it from detaching the first and second attachment members 34, 50 from each other.

Figure 5:
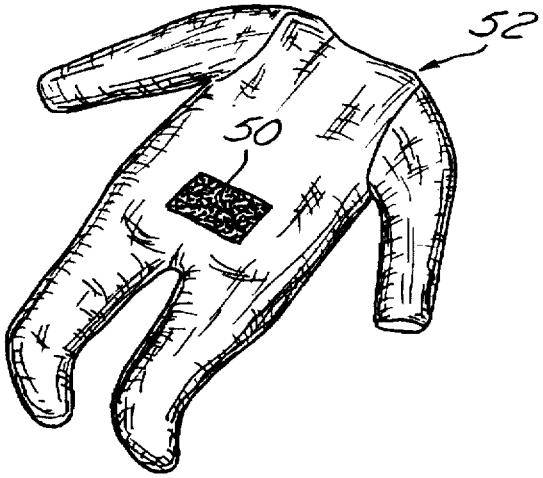
FIG. 5 is a perspective view of an infant bodysuit which may be used in the infant sleep positioning device of the present invention as an alternative to the diaper member shown in FIGS. 1–4.

Referring now to FIG. 5, in accordance with an alternative embodiment of the present invention, the positioning device 10, and in particular the belt member 18 thereof, may be used in conjunction with an infant body suit 52 rather than the previously described diaper member 36. The body suit 52 is preferably in the form of conventional infant pajamas, but includes the previously described second attachment member 50 disposed on the outer surface of the buttocks region thereof. The second attachment member 50, if included on the body suit 52, is interfaced to the first attachment member 34 in the previously described manner subsequent to the infant 12 being dressed in the body suit 52.

Though not shown, those of ordinary skill in the art will recognize that alternatives to the first and second attachment members 34, 50 may be employed in the positioning device 10 to facilitate the releasable engagement of the diaper member 36 or body suit 52 to the belt member 18. For example, the diaper member 36, body suit 52 and belt member 18 may be provided with a corresponding snap arrangement or similar fastening mechanism. Additionally, the diaper member 36 can be permanently attached to the belt member 18, with the permanently attached diaper member 36 being wrapped about the pelvic region of the infant 12 in the aforementioned manner subsequent to the positioning of the infant 12 upon the support surface 14.

Additional modifications and improvements of the present invention may also be apparent to those skilled in the art. Thus, the particular combination of parts described and illustrated herein is intended to represent only certain embodiments of the present invention, and is not intended to serve as limitations of alternative devices within the spirit and scope of the invention.

What is claimed is:

1. An infant sleep positioning device for retrofit attachment to a support structure having opposed sides and an underlying support surface extending between the opposed sides, said positioning device being adapted to maintain an infant in a back sleeping position upon the underlying support surface and comprising:

an elongate belt member defining opposed ends, said belt member being sized to be extensible along the support surface between the opposed sides of the support structure;

a pair of fastener straps attached to the belt member adjacent respective ones of the opposed ends thereof for attaching the belt member to respective ones of the opposed sides of the support structure;

a first attachment member disposed on said belt member substantially intermediate the opposed ends thereof; and a diaper member sized and configured to be wrapped about the pelvic region of the infant and including a second attachment member disposed thereon which is positioned over the buttocks of the infant when the diaper member is wrapped about the pelvic region;

said second attachment member being releasably engageable to the first attachment member for purposes of maintaining the back of the infant upon the support surface.

2. The device of claim 1 wherein each of the fastener straps comprises:

a first strap segment having a proximal end attached to the belt member and a distal end having a loop member attached thereto; and a second strap segment having a proximal end attached to the belt member and a distal end which is extensible through the loop member;

said first and second strap segments being releasably engagable to each other subsequent to the extension of the distal end of the second strap segment through the loop member.

3. The device of claim 1 wherein said first and second attachment members each comprise a patch of hook and loop fastener material.

4. The device of claim 1 wherein said belt member and said diaper member are each fabricated from a fabric material.

5. The device of claim 1 wherein said diaper member comprises:

a front region which is positionable over the stomach of the infant;

a middle region which is positionable over the crotch of the infant; and a back region which is positionable over the buttocks of the infant, said second attachment member being disposed upon the back region;

said front and back regions including securing members disposed thereon which are releasably engagable to each other for maintaining the diaper member upon the pelvic region of the infant.

6. The device of claim 5 wherein said securing members each comprise a strip of hook and loop fastener material.

* * * * *